US006615780B1

(12) United States Patent
Lin et al.

(10) Patent No.: US 6,615,780 B1
(45) Date of Patent: Sep. 9, 2003

(54) METHOD AND APPARATUS FOR A SOLENOID ASSEMBLY

(75) Inventors: Yingjie Lin, El Paso, TX (US); Conrado Carrillo, Juarez (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/222,120

(22) Filed: Aug. 16, 2002

(51) Int. Cl.[7] ..... F01L 1/34

(52) U.S. Cl. ..... 123/90.17; 123/90.11; 335/220; 335/279; 251/129.15

(58) Field of Search ..... 123/90.17; 335/279, 335/281–282, 255, 220, 297; 251/129.2, 129.08, 129.15; 137/625.65; 29/602.1

(56) References Cited

U.S. PATENT DOCUMENTS

| | | | | |
|---|---|---|---|---|
| 4,971,116 A | | 11/1990 | Suzuki et al. | 137/625.65 |
| 5,497,738 A | * | 3/1996 | Siemon et al. | 123/90.17 |
| 5,779,220 A | | 7/1998 | Nehl et al. | 251/129.15 |
| 5,836,001 A | * | 11/1998 | Hielkman et al. | 335/259 |
| 5,848,613 A | | 12/1998 | Sakaguchi et al. | 137/625.65 |
| 6,179,005 B1 | | 1/2001 | Inami | 137/625.65 |
| 6,189,519 B1 | | 2/2001 | Press et al. | 123/568.26 |
| 6,289,748 B1 | | 9/2001 | Lin et al. | 73/862.331 |
| 6,308,672 B1 | | 10/2001 | Lichti et al. | 123/90.17 |
| 6,347,616 B1 | | 2/2002 | Rodriguez et al. | 123/520 |

OTHER PUBLICATIONS

Bircann et al., Sleeveless Solenoid for a Linear Actuator, Aug. 2002, U.S. patent application Publication 2002/0104977.*

* cited by examiner

*Primary Examiner*—Thomas Denion
*Assistant Examiner*—Kyle Riddle
(74) *Attorney, Agent, or Firm*—Margaret A. Dobrowitsky

(57) ABSTRACT

A solenoid assembly includes a solenoid having a magnetic circuit comprising stationary primary and secondary pole pieces and a moveable armature. The primary pole piece includes an inner cylindrical wall operable to define, with the armature, a fixed radial gap for the passage of magnetic flux, and a tapered outer wall operable to increase the mass of the pole piece through which flux may pass, as the armature moves axially within cylindrical inner wall, the primary pole piece further includes an inwardly tapered, conical portion that extends toward the armature which operates, with an associated conical portion on a periphery of the moveable armature, to substantially maintain the axial opening force on the armature by establishing a secondary gap for the passage of magnetic flux as the armature approaches the conical tapered portion of the cylindrical wall to compensate for the saturation of magnetic flux through the fixed air gap.

40 Claims, 5 Drawing Sheets

METHOD AND APPARATUS FOR A SOLENOID ASSEMBLY

TECHNICAL FIELD

The present disclosure relates to a method and apparatus for improving performance of a solenoid assembly and, particularly, to an actuator assembly having an improved linear solenoid assembly for use in a motor vehicle.

BACKGROUND

In the newer known art, a linear actuator assembly includes primary and secondary pole pieces which cooperate to define an axially extending chamber in which is disposed a moveable armature. The armature includes a cylindrical member which moves, upon energization of the actuator, in the direction of the primary pole piece. The primary pole piece includes a substantially cylindrical center pole member with inner and outer walls defining a closed and an open end. The inner wall is substantially cylindrical and facilitates axial movement of the similarly configured armature, relative to the pole. As the armature moves in the direction of the closed end, a fixed, radial air gap is defined between the outer cylindrical wall of the armature and the inner cylindrical wall of the cylindrical center pole. Such a fixed air gap provides substantial controllability to the operation of the actuator.

It will be recognized that a solenoid assembly can be used in various actuator assemblies for actuation of a certain component and not limited to motor vehicles or internal combustion engines. One use for an actuator assembly having a linear solenoid involves cam phasing in an internal combustion engine of a motor vehicle, for example. Cam phasers are well known in the automotive art as elements of systems for reducing combustion formation of nitrogen oxides (NOX), reducing emission of unburned hydrocarbons, improving fuel economy, and improving engine torque at various speeds. As is known, under some operating conditions it is desirable to delay or advance the closing and opening of either the intake valves or the exhaust valves or both, relative to the valving in a similar engine having a fixed relationship between the crankshaft and the camshaft.

Typically, cam phasers employ a first element driven in fixed relationship to the crankshaft and a second element adjacent to the first element and mounted to the end of the camshaft in either the engine head or block. In modern automotive engines, the camshafts are typically disposed in the engine head for direct actuation of the valve tappets. Cam phasers are commonly disposed at the crankshaft and camshaft ends opposite the engine flywheel, at the "front" end of the engine. The first and second phaser elements are connected to cause the crankshaft to rotate the camshaft.

To provide a linear function to the operation of the actuator, the magnetic force acting on the armature is a function of input-amp turn of the coil, and is independent of the armature (i.e., plunger) position. However, current cam phase actuator designs provide a linear function only in a middle portion of plunger travel (approximately 2.0 mm travel distance) with a total travel of 3.0 mm and a maximum force of 14 N at 1400 amp-turns. In other words the force profile is not linear at beginning and ending travel portions of the plunger.

Currently, to approach a linear function in the operation of the actuator, the outer cylindrical wall of the cylindrical center pole is tapered outwardly, in the direction of the closed end thereof, such that as the armature moves in the direction of the closed end of the center pole, generally the translating direction of the solenoid operated rod member, the mass of the pole piece through which the magnetic flux is forced to pass increases, so as to control the rate of magnetic saturation necessary to provide the desired linear displacement versus current characteristic.

This current configuration results in a peak force intermediate of the ends of armature travel, which diminishes as the armature continues to move towards its maximum axial travel. Such a reduction in magnetic force as the armature, and associated rod member, approaches a fully opened position requires an increase in current to avoid a reduction in performance due to a loss of linear performance of the actuator.

SUMMARY

A method and apparatus for a solenoid assembly for use with an internal combustion engine that addresses the reduction in magnetic force as the armature moves closer to the primary pole piece or stop. Force reduction is minimized and stroke length is increased by providing a novel, primary pole piece and armature configuration. The primary pole piece includes an inner tapered wall and an outer tapered wall with a flat section intermediate therebetween. The primary pole piece includes a L-shaped body with a substantially cylindrical center pole member for allowing translation of an actuating rod in operable communication with the armature. The inner wall, flat section, and outer wall define a frustoconical cavity configured to receive, for axial travel therein, the associated configured armature. The armature is configured having a conical portion on a periphery of the bottom surface of the armature for magnetic engagement with the frustoconical cavity formed in the primary pole piece. As the armature moves in the direction of the closed end of the L-shaped pole piece the mass of the pole piece through which magnetic flux may pass is increased thereby providing a linear function to the operation of the actuator. The inner tapered wall of the center pole member defines a semiconical end. The semi-conical end cooperates with a similarly tapered end on the armature periphery to establish a secondary air gap which is operable to increase the opening force on the armature across its range of motion as the force decreases at the primary air gap and, more importantly, as the armature nears its fully displaced location near the closed end of the axially extending chamber of the center pole member. As the armature moves within the axial chamber, leakage flux is directed from the wall defining the cylindrical shape of the armature to the inner tapered wall of the center pole member providing an additional force component in the axial direction. As the tapered end of the armature approaches the closed end of the axial chamber, leakage flux is directed across the secondary gap defined by the associated tapered surfaces of the inner tapered wall and the armature to rapidly compensate for the decreased force component in the axial direction from the primary gap and thereby compensate for the force reduction experienced in prior linear actuators.

The above discussed and other features and advantages of the present invention will be appreciated and understood by those skilled in the art from the following detailed description and drawings.

BRIEF DESCRIPTION OF THE DRAWINGS

Referring to the exemplary drawings wherein like elements are numbered alike in the several Figures.

DETAILED DESCRIPTION

Figure 1:
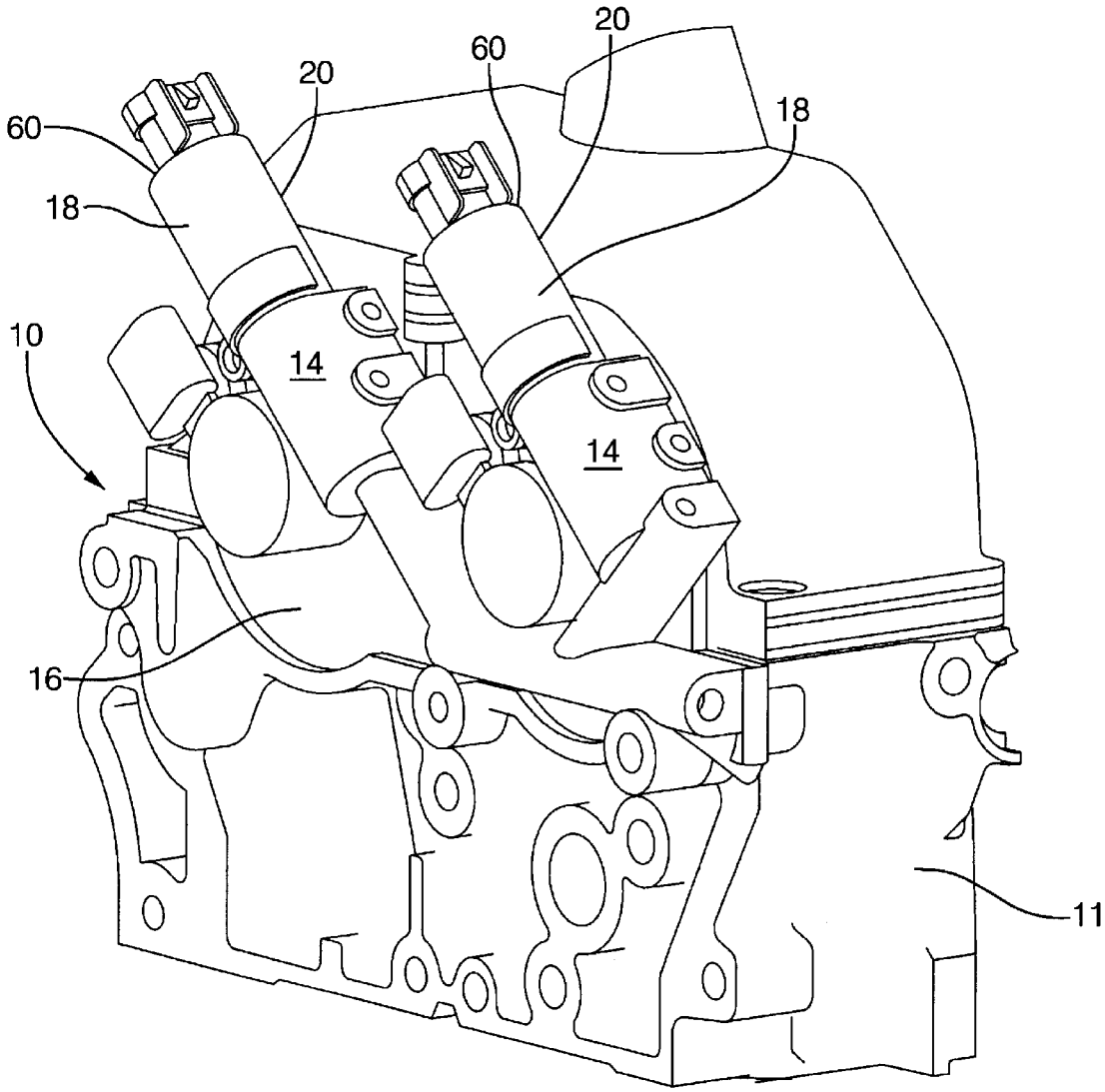
FIG. 1 is a perspective view from above showing a cam phaser module, having a dual-phaser embodiment in relationship to an engine head.

Referring to FIG. 1, a cam phaser module 10 for a dual overhead cam engine head 11 comprises two vane phaser sub-assemblies (not shown), two actuator assemblies 14 having two linear solenoids 18 and a supportive housing 16. The components are united during engine assembly to provide the final vane cam phaser (VCP) assembly, as shown in FIG. 1. For clarity, the following presentation deals with only one phaser sub-assembly and one actuator assembly for one of the cams, the assemblies for the other cam being substantially identical with those discussed. In addition, although an exemplary embodiment of the linear solenoid is discussed in relation to a cam phaser, it will be understood that the large stroke linear solenoid is not limited to cam phaser applications.

Figure 2:
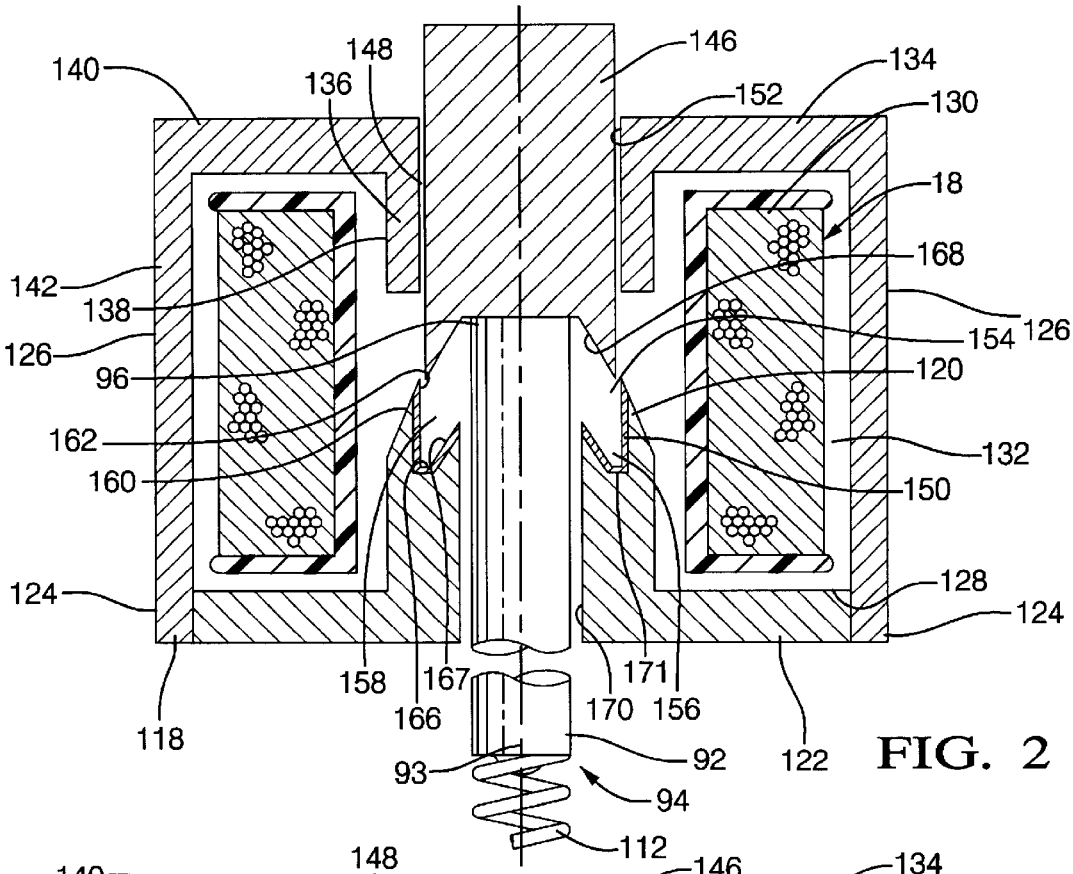
FIG. 2 is a sectional view of one linear solenoid of the dual-phaser of FIG. 1 in a first mode of operation.
Figure 3:
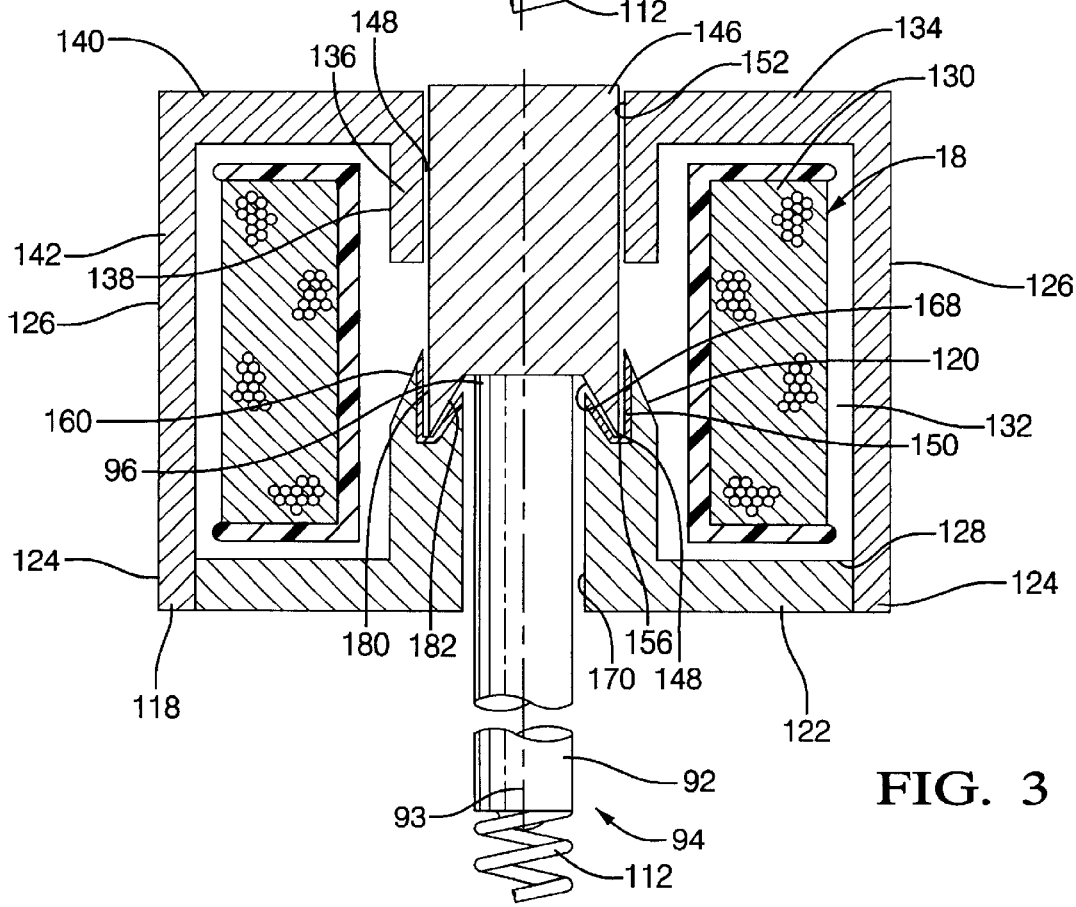
FIG. 3 is a sectional view of the linear solenoid of FIG. 2 in a second mode of operation.

Referring to FIGS. 1–3, the actuator assembly 14 includes a linear solenoid 18 which is installed in the actuator housing 20 and is connected to the second, distal end 96 of a rod 92. The solenoid 18 is operable to move the rod 92 such that the rod head 94 is moved into and out of engagement with the cam phaser module to initiate and regulate cam phasing via actuator assembly 14. As shown in FIGS. 2 and 3, a primary pole piece 118 has an L-shaped profile configuration with a substantially cylindrical center pole member 120, a cylindrical disc base 122 extending radially outwardly to an outer wall 124. The outer wall 124 is dimensioned to permit sliding insertion of the pole piece into an open end 60 of the actuator housing 20.

Closure of the L-shaped primary pole piece 118 is by a secondary pole piece 134 having a cylindrical center pole member 136 adapted for insertion within the axially extending, center opening 138 of a coil/bobbin assembly 130. The upper end of the secondary pole piece 134, as viewed in the Figures, includes a radially outwardly extending flange 140 for engagement with an outside circumference of wall 124 of primary pole piece 118 via a secondary center pole piece 142 that is substantially cylindrical having a cylindrical outer wall 126. The open end 128 of the L-shaped secondary pole piece 134 receives the annular coil/bobbin assembly 130 in space 132 formed between the upwardly projecting center pole member 142 and the outer wall 126. The outer wall 126 is dimensioned to permit sliding insertion of the pole piece into the open end 60 of the actuator housing 20. As thus far described, the magnetic circuit of the solenoid actuator 18 comprises primary pole piece 118, which establishes an extended magnetic circuit about a substantial portion of the coil 130, the secondary pole piece 134, and an armature (plunger) 146 which is fixed to, and movable with, the second end 96 of rod 92. The center pole member 120 of the primary pole piece 118 and the corresponding, center pole member 136 of the secondary pole piece 134 cooperate to define a cylindrical passage 152 having an axis which is substantially aligned with rod axis 93 and having a diameter which permits sliding axial movement of the armature 146, and the attached rod 92, therein.

The operation of the armature within the solenoid assembly is dependent on the maintenance of a circumferential, primary air gap 148 between the armature 146 and the center pole members 120,136. Establishment of the air gap 148 is through a non-magnetic sleeve 150 which is positioned in the cylindrical passage 152 of the solenoid between the pole pieces and the armature. The sleeve 150 is constructed of a thin, non-magnetic material such as stainless steel or a temperature resistant polymer and has a series of slotted openings (not shown) which extend axially and provide communication between the captive oil volume above the armature 146 and the space 158 below the armature to minimize the effect of pneumatic damping on the movement of the armature. In general, the axial slots (not shown) allow oil to flow to the armature backside for pressure balance purposes.

In the linear solenoid actuator of the type contemplated herein, a linear relationship is desirable between force and current, over the entire range of armature, and hence, plunger/rod motion. To address the deficiencies inherent in prior linear cam phase solenoid designs, the outer wall 160 of the cylindrical center pole member 120 is tapered outwardly from the actuator axis 93 in the direction of the closed end 122 of the primary pole piece 118 such that, as the armature 146 moves in the direction of the closed end 122, the mass of the pole piece through which the magnetic flux passes will increase, providing a desired linear displacement versus current characteristic. Tapered outer wall 160 tapers outwardly at an angle of about 71 degrees relative to base 122 with a tolerance of preferably about +/−2 degrees. The tapered outer wall 160 of the center pole member 120 allows the inner wall 162 to remain substantially cylindrical defining the fixed, radial air gap 148 between the outer cylindrical wall 164 of the armature 146 and the inner cylindrical wall 162 of the cylindrical center pole 120. The fixed working air gap 148 provides substantial controllability to the operation of the actuator assembly 14 since the force characteristics across the gap will not vary due to a changing gap dimension. A primary interface between armature 146 and center pole member 120 is the primary air gap 148 proximate periphery of armature 146 and inner wall 162 of the cylindrical center pole 120 shown generally at 180 in FIG. 3.

Adjacent the terminal end of the axial chamber 152, defined by the cylindrical center pole members 120 and 136, the wall 162 extends axially along the center axis 93 of the actuator toward base 122 to a length of flat section 171. Flat section 171 extends to an inner taper wall 167 that tapers inwardly to axis 93 and upwardly to plunger 146 to define a semi frustoconical chamber end 166. This frustoconical chamber end 166 is defined by an inner taper wall 167, length of flat section 171 and wall 162 of the center pole member 120. Inner wall 167 preferably has a taper of about 56 degrees with a tolerance of about +/−3 degrees relative to flat section 171. In a preferred embodiment, inner taper wall extends to a length that forms an inner wall 170 defining a bore for rod 92 to slide therethrough. Inner taper wall 167 extends to inner wall 170 from flat section 171 having a length of about 2.6 mm with a tolerance of about 0.1 mm that is about half the length of wall 162 extending relative to flat section 171. It will also be noted that flat section 171 preferably has a length of about 0.4 mm with a tolerance of about +/−0.1 mm.

Frustoconical chamber 166 cooperates with a corresponding, similarly tapered wall 168 formed on the armature 146 to thereby establish a secondary flux path or secondary interface 182 (see FIG. 3). Secondary interface 182 is operable to provide additional opening force on the armature 146, in the axial direction, across its full range of motion and, more importantly, as the armature nears its fully displaced location near the closed end terminal or surface 156 defining frustoconical chamber 166 (See FIG. 2). Tapered wall 168 preferably extends inwardly from a bottom periphery of armature 146, as in the FIGS., inwardly to axis 93 at an angle of about 64 degrees with a tolerance of about +/−2 degrees relative to flat section 171.

The secondary interface 182 between armature 146 and primary pole member 120 is the tapered wall 168 and inner wall 167. Because of the long stroke, the magnetic force tends to decrease as the armature 146 translates towards primary pole member 120. The secondary interface 182 functions to maintain the magnetic force level when armature 146 approaches half of its total travel distance. When the armature approaches this halfway mark, the magnetic force through the primary interface 180 starts to drop. However, because the air gap at the secondary interface 182 is relatively small at this point, the magnetic force generated by the secondary interface 182 starts to increase, thus compensating for the primary interface 180 magnetic force drop. The end result is a substantially flat magnetic force profile over the entire travel distance of the armature 146.

Figure 4:
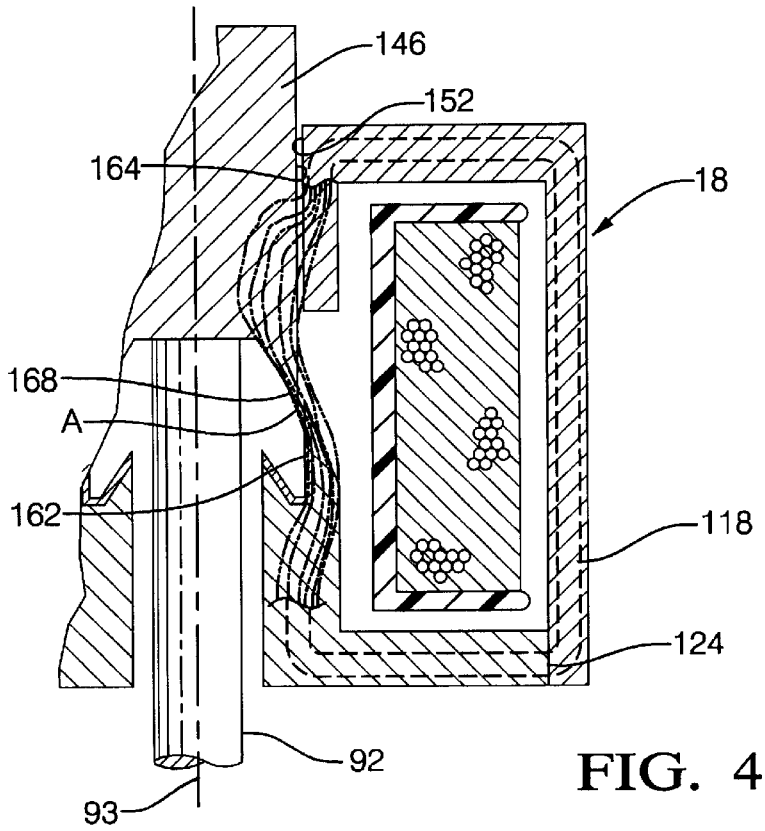
FIG. 4 is a partial, sectional view of the actuator assembly of FIG. 2 illustrating flux lines in the first mode of operation.
Figure 5:
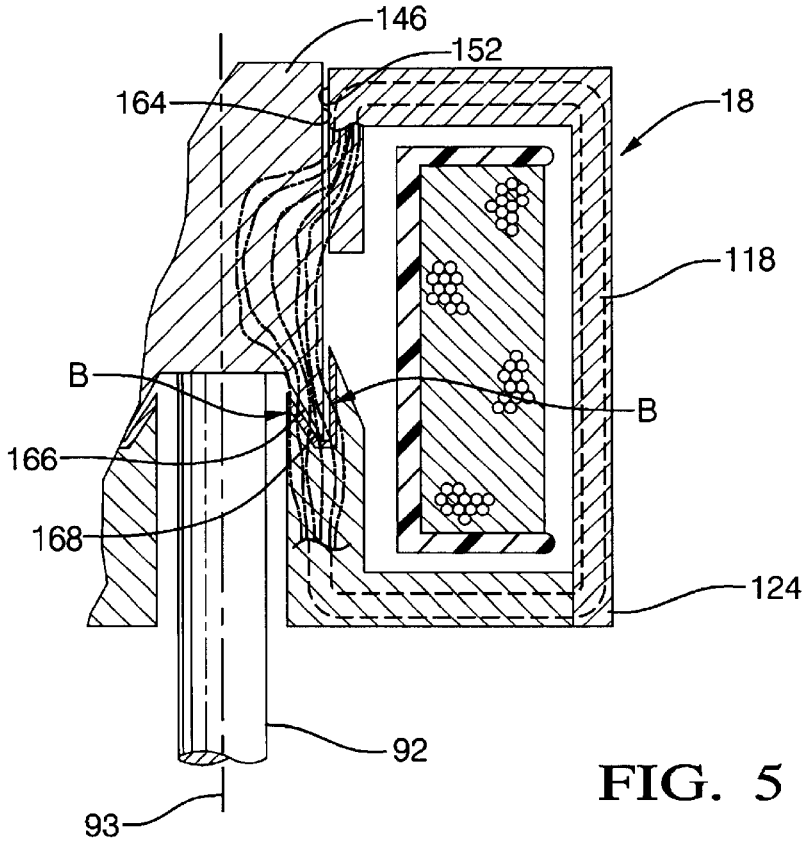
FIG. 5 is a partial, sectional view of the actuator assembly of FIG. 3 illustrating flux lines in the second mode of operation.

Specifically, as the armature 146 moves within the axial chamber 152, leakage flux "A", FIG. 4, is directed across the air gap defined by the conical armature end tapered wall 168 and the cylindrical wall 162 and wall 160 of the center pole member 120 providing additional opening force in the axial direction. The additional opening force provided in this range of armature motion results in improved actuator response from a given current input. As the armature 146 approaches the closed end of the primary pole piece 118, corresponding to a fully open position, flux "B", FIG. 5, is directed across secondary gaps defined by the associated frustoconical surfaces 166 and conical surface of tapered wall 168 of the axial chamber 152 and the armature 146, respectively. Closure of the gap resulting from continued movement of the armature 146 in the downward direction, rapidly increases the magnetic force. The increase in force operates to compensate for the reduction in opening force experienced in prior linear actuators at the limits of actuator movement. As such, the conical shaped armature 146 and corresponding tapered frustoconical chamber 166 provide an additional degree of design freedom which is not available in typical solenoid actuators. The added design freedom results in higher axial forces acting on the armature in all positions and extends the travel distance of the armature 146.

Operation of linear solenoid 18 will now be described with reference to FIGS. 2 and 3. FIG. 2 shows the linear solenoid 18 in a closed position as might be encountered when an engine is idling when no cam phase adjustment is required. In the closed position, the coil 130 remains in a non-energized state and, as a result, no force creating magnetic flux fields are established. A biasing member 112 biases the armature 146 and attached rod 92 towards the secondary pole piece 134 in the closed position to thereby seat the armature 146 against open end 60 of the actuator housing 20. In one embodiment, biasing member 112 may be a spring as depicted, but is not limited thereto. Upon a determination by an associated controller that engine operating conditions warrant the introduction of cam phasing, a current signal is transmitted to the coil 130 to establish a magnetic field across the radial air gap 148 between the outer cylindrical wall 164 of the armature 146 and the inner wall 152 of the center pole member 120 of the primary pole piece 118. In addition, as shown in FIG. 4, leakage flux "A" is directed across the air gap defined by the conical armature end tapered wall 168 and the cylindrical wall 162 and tapered wall 160 of the center pole member 120 providing additional opening force in the opening direction. The magnetic fields cause an opening force to be exerted on the armature 146 in the direction of the rod axis 93 and opposing the bias exerted by the biasing member 112, and the rod head 94, in the closing direction. As the force generated by the magnetic fields exceeds the spring bias and rod head load, the armature 146 and the attached actuator assembly 14 moves axially such that the rod member is urged to alter the cam phase. As the armature approaches the terminal end of the axial chamber 152, associated with a fully open or armature stopped position, flux "B", shown in FIG. 5, is directed across the secondary gap defined by the associated conical surfaces 168 and frustoconical chamber 166 surfaces of the axial chamber 152 and the armature 146. Closure of the gap resulting from continued movement of the armature 146 in the rod opening direction, rapidly increases the magnetic force.

Figure 6:
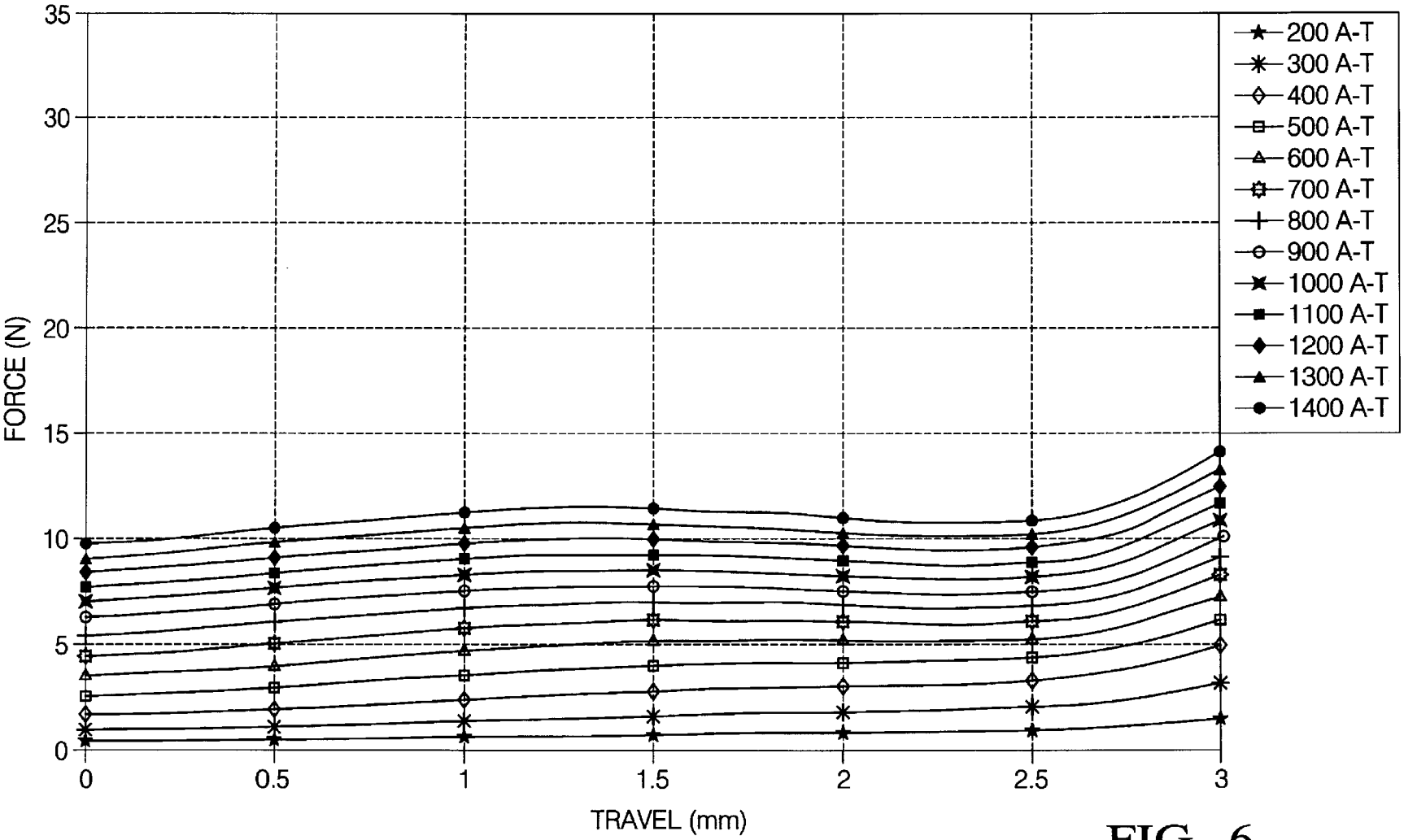
FIG. 6 is a graph of simulation results illustrating magnetic force profiles relative to plunger travel distance in current solenoid cam phase designs.

FIG. 6 illustrates the limited linear range, travel distance and force of current cam phase solenoid design. It will be recognized that thirteen curves relative to Force vs. Travel are shown, wherein each curve corresponds to a certain number of amp-turns ranging from 200 amp-turn (A-T) to 1400 A-T on coil 130. The current cam phase design has a substantially linear portion from about 0.5 mm to about 2.0 mm for each curve. The maximum travel distance is about 3.0 mm while the maximum force is 14N with 1400 A-T.

Figure 7:
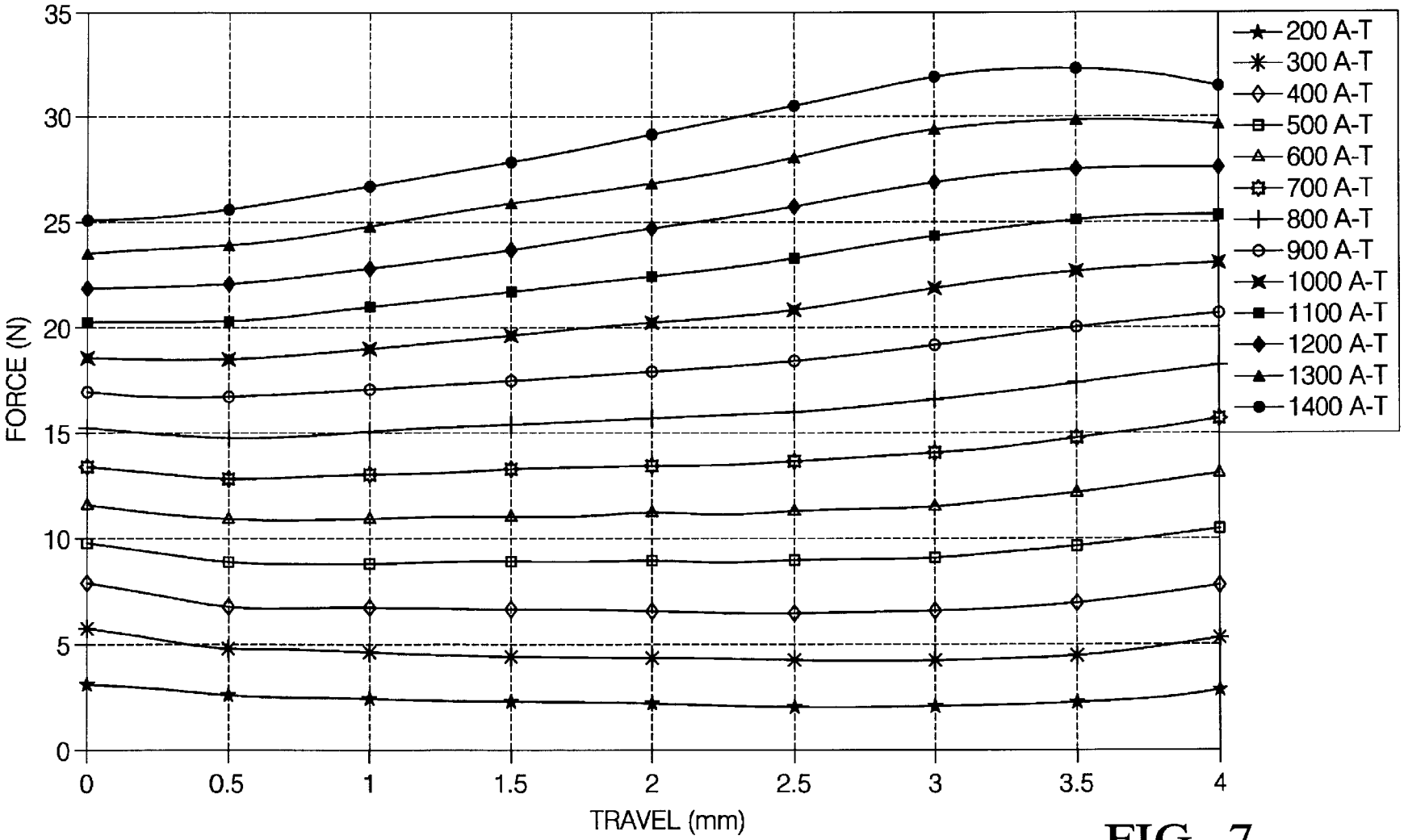
FIG. 7 is a graph of simulation results illustrating magnetic force profiles relative to plunger travel distance in an exemplary embodiment of a linear solenoid.

After incorporating the exemplary configurations of the plunger and primary pole piece in a linear solenoid, simulation results are reflected in FIG. 7. Results obtained include an increase of the linear and dynamic range of the flow curve, an increase in the magnetic force profile and increase in travel distance (i.e., 4 mm). As shown in FIG. 7, the exemplary solenoid design provides a maximum force of more than 30N with 1400 A-T. Thus the linear range is expanded and magnetic force profile is increased while improving input power requirement compared with present designs.

In summary, the present disclosure discloses a linear solenoid for cam phase actuators that provides a wide linear range using existing known components for such a linear solenoid on a vehicle. The components are preferably made from low carbon steel, while the rod material is preferably made from non-magnetic stainless steel. Although the linear solenoid disclosed herein is discussed for use with cam phasers, it will be noted that the contemplated use is of the large stroke linear solenoid and may be implemented in many other applications requiring a large force, large stroke and linear magnetic package design.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electromagnetic solenoid assembly having a magnetic circuit configured to provide a linear magnetic force to an actuation assembly comprising:

a primary pole piece;

a secondary pole piece in magnetic communication with said primary pole piece, said primary and secondary pole pieces defining an axial chamber; and an armature, associated with a rod member, said armature and rod member being moveable in said chamber and in operable communication with the actuation assembly, wherein said primary pole piece having a center pole member including a cylindrical inner wall, open at a first end, for receiving said moveable armature and said rod member, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein said inner wall extends from said flat section to a height of about one half of a height of said outwardly tapering wall extending from said flat section.

2. The solenoid assembly of claim 3, said conical portion formed on said periphery of said moveable armature operable with said inner wall to define a passage for leakage flux as said armature moves in said axial chamber to further increase axial force on said armature to maintain a substantially linear magnetic profile for a distance traveled by said armature.

3. The solenoid assembly of claim 1, wherein said outwardly tapering wall tapers outwardly and down away from said armature at an angle of about 69 degrees to about 73 degrees relative to said flat section.

4. The solenoid assembly of claim 1, wherein said inner wall tapers inwardly and upward toward said armature at an angle of about 53 degrees to about 59 degrees relative to said flat section.

5. The solenoid assembly of claim 1, wherein said conical portion formed on said periphery of said moveable armature includes an axially inward taper from the periphery of said armature, said inward taper defining a frustoconical cavity on a bottom surface of said armature.

6. The solenoid assembly of claim 5, wherein said inward taper forms an angle of about 62 degrees to about 66 degrees relative to said flat section.

7. The solenoid assembly of claim 1, wherein a bias is applied to said armature, wherein said bias includes a biasing member operably connected to said armature, said biasing member biasing said armature away from said primary pole piece.

8. The solenoid assembly of claim 1, wherein said magnetic circuit includes a coil disposed around said armature for operably energizing the solenoid.

9. The solenoid assembly of claim 1, wherein further movement of said armature toward said primary pole piece is operably prevented when said conical portion on said periphery of said armature meets said flat section and said inner wall.

10. A solenoid assembly for cam phasing in an internal combustion engine comprising:

an electromagnetic solenoid actuator having a magnetic circuit including primary and secondary pole pieces defining an axial chamber; and an armature, associated with a rod member, said armature and rod member being moveable in said chamber, wherein said primary pole piece having a center pole member including a cylindrical inner wall, open at a first end, for receiving said moveable armature and said rod member, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein said inner wall extends from said flat section to a height of about one half of a height of said outwardly tapering wall extending from said flat section.

11. The solenoid assembly of claim 10, said conical portion formed on said periphery of said moveable armature operable with said inner wall to define a passage for leakage flux as said armature moves in said axial chamber to further increase axial force on said armature to maintain a substantially linear magnetic profile for a distance traveled by said armature.

12. The solenoid assembly of claim 10, wherein said outwardly tapering wall tapers outwardly and down away from said armature at an angle of about 69 degrees to about 73 degrees relative to said flat section.

13. The solenoid assembly of claim 10, wherein said inner wall tapers inwardly and upward toward said armature at an angle of about 53 degrees to about 59 degrees relative to said flat section.

14. The solenoid assembly of claim 10, wherein said conical portion formed on said periphery of said moveable armature includes an axially inward taper from the periphery of said armature, said inward taper defining a frustoconical cavity on a bottom surface of said armature.

15. The solenoid assembly of claim 14, wherein said inward taper forms an angle of about 62 degrees to about 66 degrees relative to said flat section.

16. The solenoid assembly of claim 10, wherein a bias is applied to said armature, wherein said bias includes a biasing member operably connected to said armature, said biasing member biasing said armature away from said primary pole piece.

17. The solenoid assembly of claim 10, wherein said magnetic circuit includes a coil disposed around said armature for operably energizing the solenoid.

18. The solenoid assembly of claim 10, wherein further movement of said armature toward said primary pole piece is operably prevented when said conical portion on said periphery of said armature meets said flat section and said inner wall.

19. A cam phaser assembly for cam phasing in an internal combustion engine comprising:

a cam phaser module for an engine head having a vane phaser sub-assembly, and an actuator assembly having a solenoid assembly, the solenoid assembly including;

an electromagnetic solenoid actuator having a magnetic circuit including primary and secondary pole pieces defining an axial chamber; and an armature, associated with a rod member, said armature and rod member being moveable in said chamber, wherein said primary pole piece having a center pole member including a cylindrical inner wall, open at a first end, for receiving said moveable armature and said rod member, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein said inner wall extends from said flat section to a height of about one half of a height of said outwardly tapering wall extending from said flat section.

20. The cam phaser assembly of claim 19, said conical portion formed on said periphery of said moveable armature operable with said inner wall to define a passage for leakage flux as said armature moves in said axial chamber to further increase axial force on said armature to maintain a substantially linear magnetic profile for a distance traveled by said armature.

21. The cam phaser assembly of claim 19, wherein said outwardly tapering wall tapers outwardly and down away from said armature at an angle of about 69 degrees to about 73 degrees relative to said flat section.

22. The cam phaser assembly of claim 19, wherein said inner wall tapers inwardly and upward toward said armature at an angle of about 53 degrees to about 59 degrees relative to said flat section.

23. The cam phaser assembly of claim 19, wherein said conical portion formed on said periphery of said moveable armature includes an axially inward taper from the periphery of said armature, said inward taper defining a frustoconical cavity on a bottom surface of said armature.

24. The cam phaser assembly of claim 23, wherein said inward taper forms an angle of about 62 degrees to about 66 degrees relative to said flat section.

25. The cam phaser assembly of claim 19, wherein a bias is applied to said armature, wherein said bias includes a biasing member operably connected to said armature, said biasing member biasing said armature away from said primary pole piece.

26. The cam phaser assembly of claim 19, wherein said magnetic circuit includes a coil disposed around said armature for operably energizing the solenoid.

27. The cam phaser assembly of claim 19, wherein further movement of said armature toward said primary pole piece is operably prevented when said conical portion on said periphery of said armature meets said flat section and said inner wall.

28. A method to extend the stroke and linear magnetic force acting on a moveable armature in a solenoid assembly relative to a primary pole piece, the method comprising:

configuring the armature from a solid cylinder material having a bottom surface cavity formed therein; and configuring a secondary pole piece in magnetic communication with said primary pole piece, said primary and secondary pole pieces defining an axial chamber; wherein said primary pole piece having a center pole member including a cylindrical inner wall, open at a first end, for receiving said moveable armature, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein said inner wall extends from said flat section to a height of about one half of a height of said outwardly tapering wall extending from said flat section.

29. The method of claim 28, said conical portion formed on said periphery of said moveable armature operable with said inner wall to define a passage for leakage flux as said armature moves in said axial chamber to further increase axial force on said armature to maintain a substantially linear magnetic profile for a distance traveled by said armature.

30. The method of claim 28, wherein said outwardly tapering wall tapers outwardly and down away from said armature at an angle of about 69 degrees to about 73 degrees relative to said flat section.

31. The method of claim 28, wherein said inner wall tapers inwardly and upward toward said armature at an angle of about 53 degrees to about 59 degrees relative to said flat section.

32. The method of claim 28, wherein said conical portion formed on said periphery of said moveable armature includes an axially inward taper from the periphery of said armature, said inward taper defining a frustoconical cavity on a bottom surface of said armature.

33. The method of claim 32, wherein said inward taper forms an angle of about 62 degrees to about 66 degrees relative to said flat section.

34. The method of claim 28, wherein a bias is applied to said armature, wherein said bias includes a biasing member operably connected to said armature, said biasing member biasing said armature away from said primary pole piece.

35. The method of claim 28, wherein said magnetic circuit includes a coil disposed around said armature for operably energizing the solenoid.

36. The method of claim 28, wherein further movement of said armature toward said primary pole piece is operably prevented when said conical portion on said periphery of said armature meets said flat section and said inner wall.

37. An electromagnetic solenoid assembly having a magnetic circuit configured to provide a linear magnetic force to an actuation assembly comprising:

a primary pole piece;

a secondary pole piece in magnetic communication with said primary pole piece, said primary and secondary pole pieces defining an axial chamber; and an armature, associated with a rod member, said armature and rod member being moveable in said chamber and in operable communication with the actuation assembly, wherein said primary pole piece having a center pole member including a cylindrical inner wall, open at a first end, for receiving said moveable armature and said rod member, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein further movement of said armature toward said primary pole piece is operably prevented when said conical portion on said periphery of said armature meets said flat section and said inner wall.

38. A solenoid assembly for cam phasing in an internal combustion engine comprising:

an electromagnetic solenoid actuator having a magnetic circuit including primary and secondary pole pieces defining an axial chamber; and an armature, associated with a rod member, said armature and rod member being moveable in said chamber, wherein said primary pole piece having a center pole member including a cylindrical inner wall, open at a first end, for receiving said moveable armature and said rod member, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein further movement of said armature toward said primary pole piece is operably prevented when said conical portion on said periphery of said armature meets said flat section and said inner wall.

39. A cam phaser assembly for cam phasing in an internal combustion engine comprising:

a cam phaser module for an engine head having a vane phaser sub-assembly, and an actuator assembly having a solenoid assembly, the solenoid assembly including;

an electromagnetic solenoid actuator having a magnetic circuit including primary and secondary pole pieces defining an axial chamber; and an armature, associated with a rod member, said armature and rod member being moveable in said chamber, wherein said primary pole piece having a center pole member including a cylindrical inner wall, open at a first end, for receiving said moveable armature and said rod member, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein further movement of said armature toward said primary pole piece is operably prevented when said conical portion on said periphery of said armature meets said flat section and said inner wall.

40. A method to extend the stroke and linear magnetic force acting on a moveable armature in a solenoid assembly relative to a primary pole piece, the method comprising:

configuring the armature from a solid cylinder material having a bottom surface cavity formed therein; and configuring a secondary pole piece in magnetic communication with said primary pole piece, said primary and secondary pole pieces defining an axial chamber; wherein said primary pole piece having a center pole member including a cylindrical inner wall, open at a first end, for receiving said moveable armature, said armature and said cylindrical inner wall defining a fixed, radially extending, primary air gap for flux passage thereacross, and an outer wall extending in an outward taper from said first, open end of said center pole member to a second end of said center pole member, said outwardly tapering wall operable to increase the mass of the pole piece through which said magnetic circuit operates as said armature moves from said first, open end of said center pole member towards said second end, said inner cylindrical wall further including an axially inwardly extending flat section, an inner wall extending in an inward taper extending from said flat section towards said armature adjacent said second end of said center pole member, said inner wall operable with an associated conical portion formed on a periphery of said moveable armature to define a secondary air gap for flux passage thereacross as said armature approaches said second end of said pole piece, and operable to increase axial force on said armature in relation to said primary air gap for flux passage, wherein further movement of said armature toward said primary pole piece is operably prevented when said conical portion on said periphery of said armature meets said flat section and said inner wall.

* * * * *